US006015335A

United States Patent [19]

Roberts

[11] Patent Number: 6,015,335

[45] Date of Patent: Jan. 18, 2000

[54] APPARATUS FOR DRESSING INSIDE DIAMETER SAWS

[75] Inventor: Russell Bradley Roberts, Simpsonville, S.C.

[73] Assignee: MEMC Electronic Materials, Inc., St. Peters, Mo.

[21] Appl. No.: 08/991,962

[22] Filed: Dec. 17, 1997

[51] Int. Cl.[7] ..... B24B 53/00

[52] U.S. Cl. ..... 451/72; 125/11.18

[58] Field of Search ..... 451/72, 56, 443, 451/21; 125/11.18, 11.03

[56] References Cited

U.S. PATENT DOCUMENTS

| | | | |
|---|---|---|---|
| 1,909,953 | 5/1933 | Heald | 451/150 |
| 1,972,826 | 9/1934 | Haas | 451/443 |
| 4,699,118 | 10/1987 | Tsuruta et al. . | |
| 4,926,836 | 5/1990 | Abe . | |
| 5,144,938 | 9/1992 | Seeburger et al. . | |
| 5,632,666 | 5/1997 | Peratello et al. . | |

FOREIGN PATENT DOCUMENTS

| | | | |
|---|---|---|---|
| 0144663 | 9/1982 | Japan | 125/11.18 |

OTHER PUBLICATIONS

Toyo Advanced Technologies, Development of Fully–Automatic Slicing Machine, published prior to Dec. 17, 1997.

Mitsubishi Metal Corporation, "Mitsubishi Tracking Dressing Operation System Operation Guide", published prior to Dec. 17, 1997.

Cybeo Systems, "Guidance in the Usage of ID Blades", published prior to Dec. 17, 1997.

Description of known prior art device first used prior to Dec. 17, 1997, unpublished.

*Primary Examiner*—Robert A. Rose

*Attorney, Agent, or Firm*—Senniger, Powers, Leavitt & Roedel

[57] ABSTRACT

Apparatus for dressing the cutting surfaces around a central opening of an annular inside diameter saw. The apparatus includes a base and a shaft mounted on the base for rotation on a longitudinal axis of the shaft. The shaft is adapted to be positioned adjacent the central opening of the saw. The apparatus also includes a fixture mounted on the shaft for holding a dressing stone in the central opening of the saw. In addition, the apparatus includes a motor for rotating the shaft to move the dressing stone held by the fixture along an arc centered on the longitudinal axis of the shaft into engagement with the cutting surfaces of the saw when the saw is rotating thereby to remove deposits from the cutting surfaces of the saw.

9 Claims, 4 Drawing Sheets

APPARATUS FOR DRESSING INSIDE DIAMETER SAWS

BACKGROUND OF THE INVENTION

This invention relates generally to inside diameter saws for slicing semiconductor wafers and more particularly to apparatus for dressing cutting surfaces of inside diameter saws.

One apparatus used for slicing ingots of monocrystalline semiconductor material into wafers is an inside diameter saw having a thin annular saw blade with cutting surfaces surrounding a central opening in the blade. The cutting surfaces have diamonds embedded in a layer of nickel for cutting the ingots. As the blade slices the ingots, semiconductor material dust and debris collect between the diamonds on the cutting surfaces thereby reducing the ability of the saw blade to cut through the ingot and increasing the cutting resistance of the blade. Moreover, the diamonds chip which also reduces the ability of the blade to cut through the ingot and increases the cutting resistance.

Cutting resistance during slicing causes the blade to deflect transverse to the cutting direction and out of the plane of the blade. If sufficiently large, this deflection can produce undesirable warpage, saw marks and thickness variations in the sliced wafers. The warpage cannot be eliminated by subsequent operations such as lapping. Even though saw marks and thickness variation can be eliminated by increasing stock removal in subsequent operations, the resulting material loss and time inefficiencies are highly undesirable.

The cutting resistance encountered by the blade is primarily a function of the amount of dust and debris lodged between the diamonds on the cutting surfaces of the blade. To limit the cutting resistance and resulting blade deflection, it is standard industry practice to dress the cutting surfaces of the blade using a special dressing stone to remove the dust and debris from between the diamonds on the cutting surfaces. In addition, dressing removes some of the nickel holding the diamonds in place so more of the diamonds are exposed. To dress the cutting surfaces, the dressing stone is pushed against the cutting surfaces of the blade. The dressing operation is critical to controlling the quality of the wafers sliced.

Various equipment and methods have been employed for dressing the cutting surfaces of inside diameter saws. Some saws include dedicated apparatus for dressing the cutting surfaces. Frequently, these dedicated apparatus are adapted to measure the warpage of the wafers cut or the deflection of the saw blade and to automatically dress the saws when needed. However, these apparatus are relatively complicated and expensive to operate since a separate apparatus (frequently including dedicated measurement equipment) is needed for each saw. Another type of saw dressing apparatus is portable so that it may be moved from saw to saw as needed. Generally, these portable apparatus are manually controlled by an operator who physically pushes the dressing stone against the saw blade. The portability of these apparatus results in reduced apparatus cost, but the manual operation increases the variability of the dressing process since it is highly dependent upon the subjective judgment and actions of the saw operator. Consequently, a dressing operation performed using such portable apparatus does not always result in the desired correction of cut.

SUMMARY OF THE INVENTION

Among the several objects and features of the present invention may be noted the provision of a dressing apparatus which is portable from saw to saw; the provision of such an apparatus which consistently and repeatably dresses the cutting surfaces of inside diameter saw blades; the provision of such an apparatus which may be used in combination with other similar apparatus to dress the blades of several saws simultaneously; the provision of such an apparatus which is inexpensive to operate; and the provision of such an apparatus which increases the rate of production of wafers while improving the quality of wafers produced.

Briefly, apparatus of this invention is for dressing the cutting surfaces around a central opening of an annular inside diameter saw. The apparatus comprises a base and a shaft mounted on the base for rotation on a longitudinal axis of the shaft. The shaft is adapted to be positioned adjacent the central opening of the saw. The apparatus also comprises a fixture mounted on the shaft for holding a dressing stone in the central opening of the saw. In addition, the apparatus comprises a motor for rotating the shaft to move the dressing stone held by the fixture along an arc centered on the longitudinal axis of the shaft into engagement with the cutting surfaces of the saw when the saw is rotating thereby to remove deposits from the cutting surfaces of the saw.

In another aspect, the invention includes a method of dressing the cutting surfaces of an annular inside diameter saw. The method comprises the steps of mounting a dressing stone in a fixture mounted on a shaft and positioning the mounted dressing stone inside the central opening of the saw. Further, the method comprises the step of actuating a motor operatively connected to the shaft for rotating the shaft to move the dressing stone held by the fixture along an arc lying in a plane generally perpendicular to a central axis of the saw to bring the stone into engagement with the cutting surfaces of the saw thereby to remove deposits from the surface.

Other objects and features of the invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
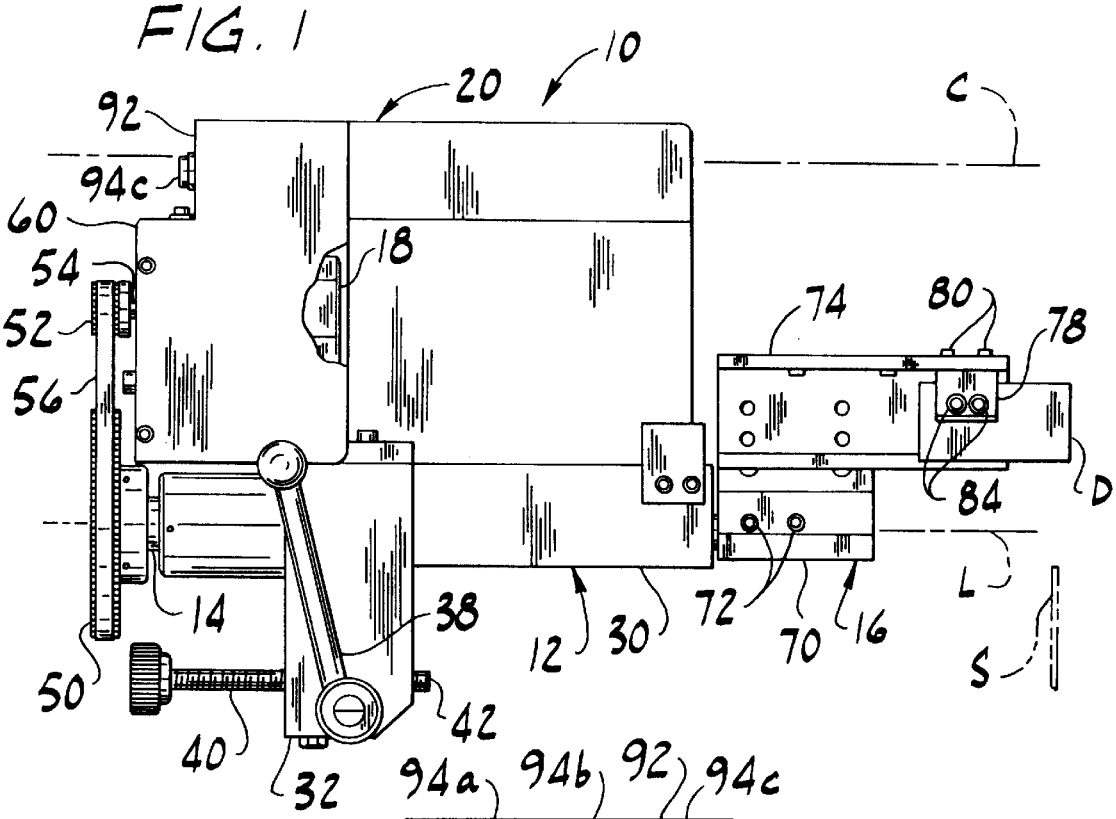
FIG. 1 is a right side elevation of apparatus of the present invention partially broken away to show interior features of the apparatus.

Referring now to the drawings and in particular to FIG. 1, apparatus for dressing an annular inside diameter saw (designated by S in FIG. 3) is generally indicated in its entirety by the reference numeral 10. The apparatus 10 comprises a base, generally designated by 12, which rotatably supports a shaft 14. The shaft 14 has a fixture, generally designated by 16, mounted thereon for holding a dressing stone D. A stepper motor 18 turns the shaft to drive the dressing stone toward the saw S in response to signals from a controller, generally designated by 20, mounted on the base.

Figure 2:
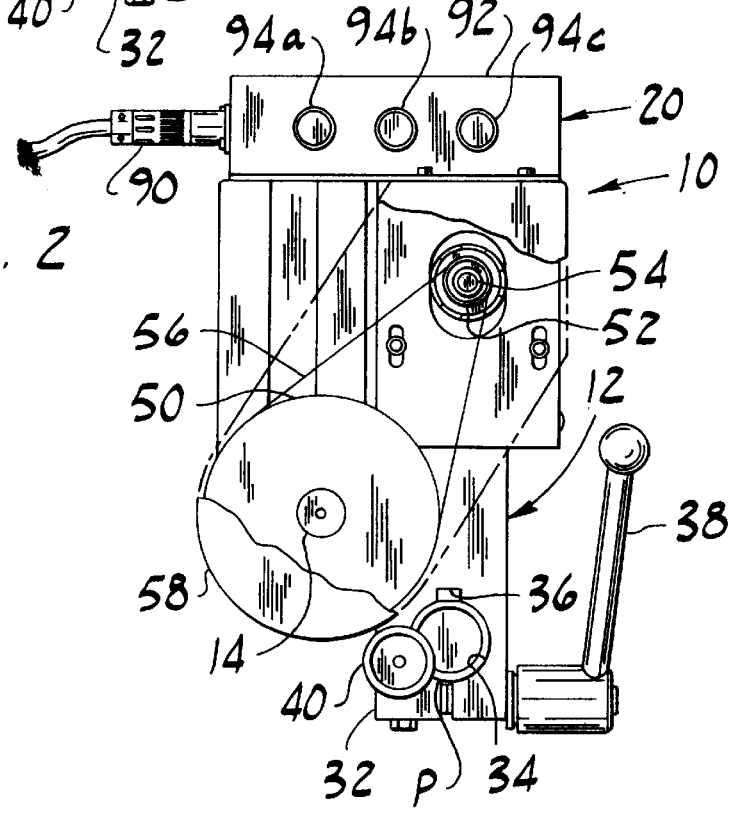
FIG. 2 is a rear elevation of the apparatus showing a belt guard partially broken away.

The base 12 includes an elongate horizontal housing 30 having a hollow interior with one or more bearings (not shown) for rotatably supporting the shaft 14 for rotation about a longitudinal axis L of the shaft. The base 12 also includes a clamp 32 for releasably clamping the apparatus 10 on a horizontal support post P (FIG. 2) of a conventional saw assembly (not shown) so that the longitudinal axis L of the shaft 14 is positioned adjacent a central opening O (FIG. 3) of the saw S. As shown in FIG. 2, the two jaws of the clamp 32 define an opening 34 which is sized and shaped for receiving the post P. Although the opening 34 may have other shapes without departing from the scope of the present invention, the opening of the preferred embodiment is generally circular and includes a slot 36 for accepting a rib along the top of the post P to prevent the apparatus 10 from turning on the post. A lever 38 is provided on the clamp 32 for tightening the jaws of the clamp on the post P to hold the apparatus 10 in position. The clamp 32 also includes a screw 40 having an end 42 adapted to engage a face of the saw assembly to set and adjust the longitudinal position of the dressing stone D with respect to the saw S prior to tightening the clamp, as will be explained in greater detail below.

As illustrated in FIG. 2, a first timing pulley or gear 50 is connected to the rearward end of the shaft 14 (the left end as shown in FIG. 1), and a second timing pulley or gear 52 is connected to an output shaft 54 on the motor 18. A timing belt 56 engages the first and second pulleys 50, 52, respectively, to operatively connect the motor 18 to the shaft 14 so that the shaft rotates in response to rotation of the motor output shaft 54 thereby transmitting power from the motor to the shaft 14. Each of the gears 50, 52 has evenly spaced teeth about its perimeter, and the timing belt 56 also has teeth which engage the teeth on the gears to prevent the belt from slipping on the gears. A guard 58 (shown partially broken away in FIG. 2 and omitted from FIG. 1) surrounds the gears 50, 52 and belt 56 to protect them and prevent contact with the moving parts of the apparatus 10. Similarly, a housing 60 surrounds the motor 18 to protect it. Although other motors may be used without departing from the scope of the present invention, the motor of the preferred embodiment is a Model OEM57-51-MO stepper motor available from Compumotor Division of Parker Hannifin Corporation of Rohnert Park, Calif.

Figure 3:
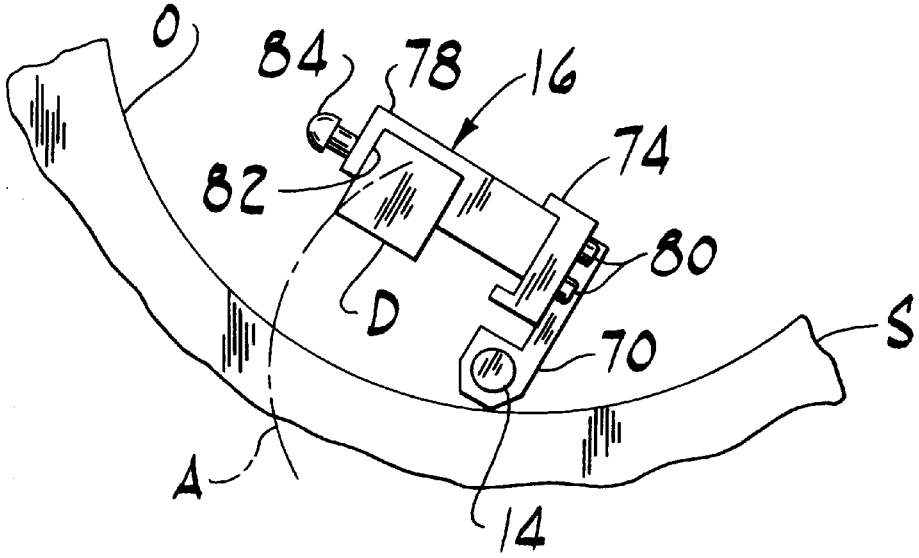
FIG. 3 is a front elevation of a holding fixture of the apparatus and dressing stone shown in relation to an inside diameter saw before dressing a cutting surface.
Figure 4:
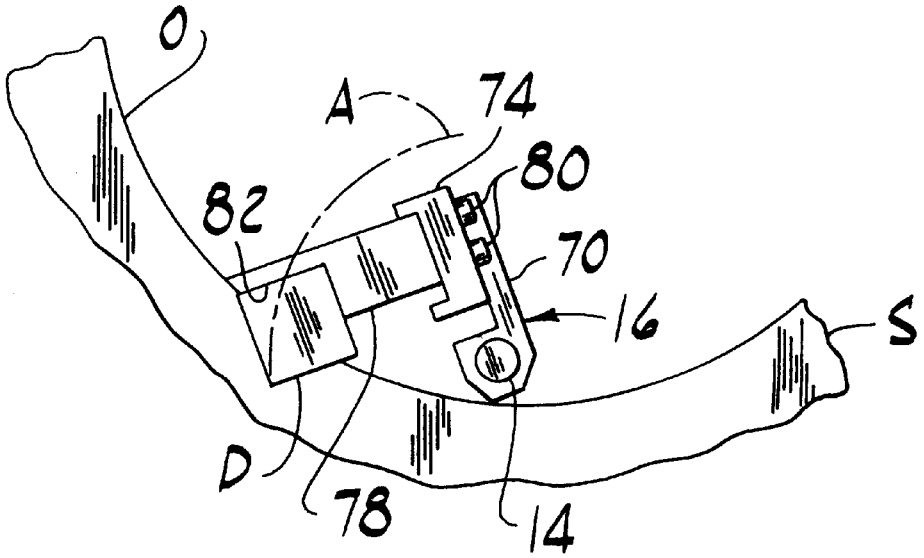
FIG. 4 is a front elevation of the holding fixture and stone dressing the cutting surface.
Figure 5:
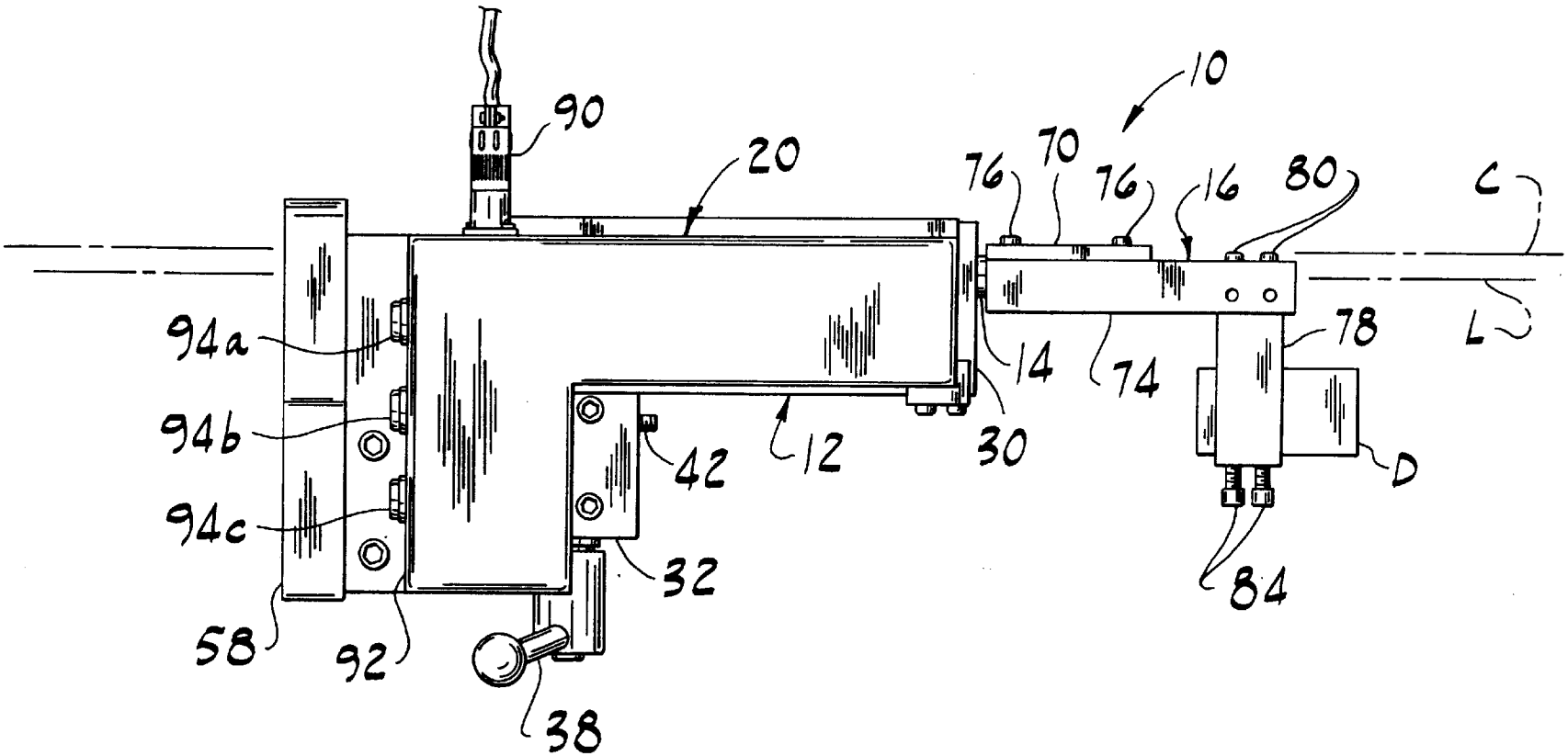
FIG. 5 is a top plan of the apparatus.

As illustrated in FIG. 3, the fixture 16 comprises a lever 70 attached to the forward end of the shaft 16 with screw fasteners 72 (FIG. 1) so the lever extends laterally and generally upward from the shaft. A longitudinal arm 74 is attached to the lever 70 with screw fasteners 76 (FIG. 5) so it extends forward from the lever, and a mount 78 is attached to the longitudinal arm with additional screw fasteners 80 so it extends perpendicular to both the lever and the arm. The mount 78 has a recess 82 for receiving the dressing stone D. Screws 84 extend through threaded holes (not shown) in the mount 78 for engaging the stone D to hold it in the fixture 16. The screws 84 permit the longitudinal position of the stone D with respect to the fixture 16 to be adjusted. As will be apparent to those skilled in the art, when the shaft 14 rotates, the fixture 16 moves the stone D through an arc A lying in a plane generally perpendicular to a central axis C (FIG. 1) of the saw. As the stone D moves through this arc A, it engages the cutting surfaces of the saw S and removes deposits from those surfaces as illustrated in FIG. 4. As explained above, these deposits include dust and debris lodged between the diamonds, as well as some of the nickel in which the diamonds are embedded.

Figure 6:
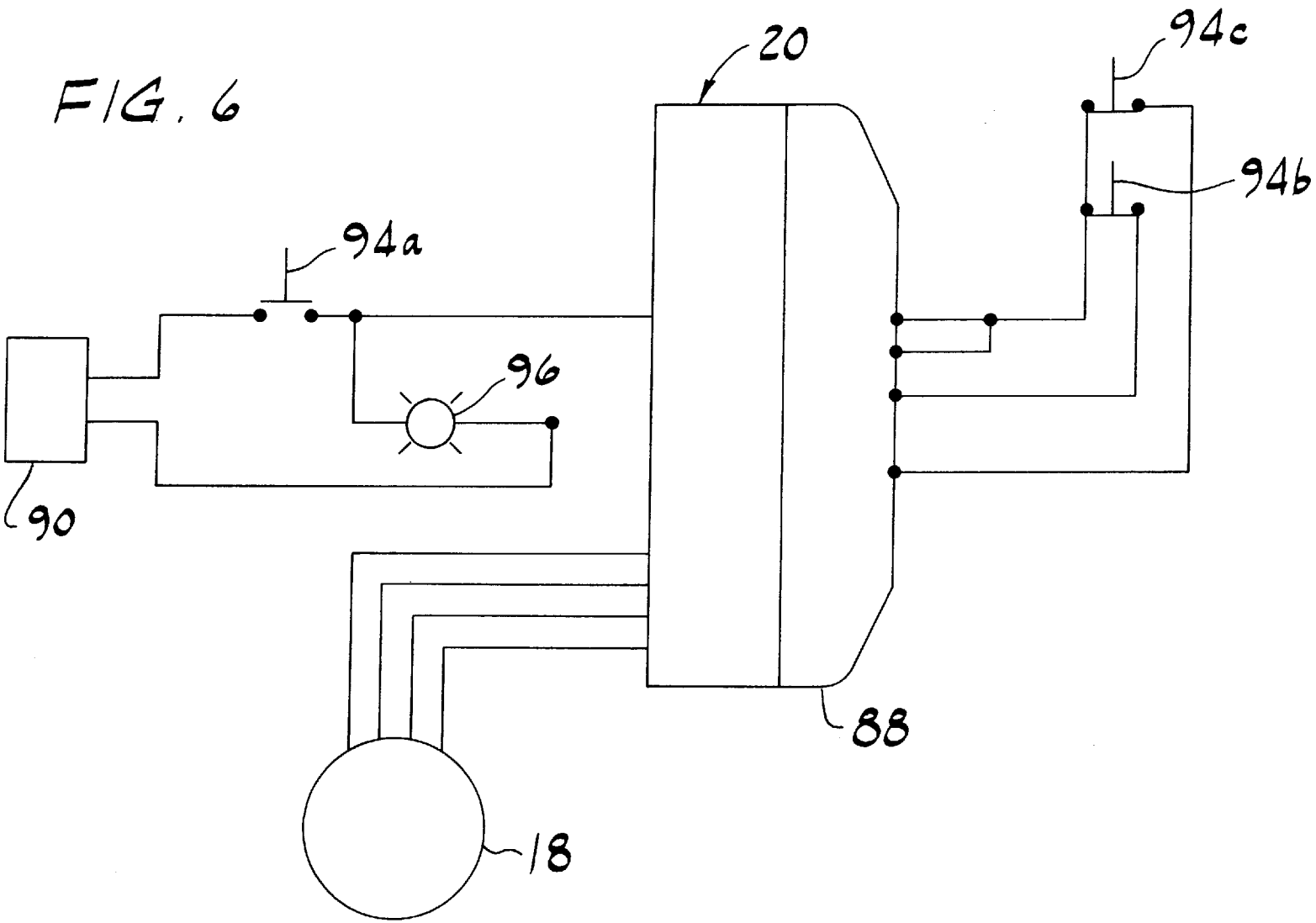
FIG. 6 is a electrical schematic for the apparatus.

The controller 20 shown in FIG. 1 includes an indexer/drive 88 (FIG. 6) which is electronically connected to the motor 18 for controlling the rotational movement of the output shaft 54 of the motor. The controller 20 and motor 18 are powered by an external low voltage power supply (not shown) connected to the controller with a standard electrical connector 90 (e.g., an RS-232 connector), shown in FIGS. 2 and 5. As will be apparent to those skilled in the art, several apparatus 10 may be simultaneously powered by the same power supply if desired. Although other indexer/drives may be used without departing from the scope of the present invention, the indexer/drive 88 of the preferred embodiment is a Model OEM650X indexer/drive made by Compumotor Division of Parker Hannifin Corporation. This indexer/drive includes static random access memory which is able to store programs even when the apparatus 10 is disconnected from the power supply. Moreover, this indexer/drive has the capability of being programmed to change the speed and/or movement profiles of the stone D over time to optimize the dressing process. As shown in FIG. 2, a control panel 92 for operating the controller 20 is mounted on the housing 60 surrounding the motor 18. The panel 92 includes three buttons 94*a*–94*c* which control the controller. Button 94*a* switches power to the apparatus 10 on and off; button 94*b* signals the controller 20 to lower the stone D to a position adjacent the saw S to check the position of the stone relative to the saw; and button 94*c* signals the controller to perform a dressing cycle. This operation is described below. As illustrated in FIG. 6, button 94*a* includes a light 96 for indicating when the apparatus 10 is energized.

To use the apparatus 10 described above, an operator mounts the apparatus on a saw assembly by attaching the clamp 32 to the post P of the assembly. The axial position of the apparatus 10 relative to the saw S may be adjusted by sliding the apparatus 10 backward and forward on the post P and turning the adjustment screw 40 as necessary before tightening the lever 38 to hold the apparatus in place. A dressing stone D may be installed in the mounting fixture 16 of the apparatus 10 either before or after it is clamped to the post. The stone D is installed by inserting the stone in the recess 82 of the mounting fixture 16 and tightening the screws 84 to hold the stone in place. Once the apparatus 10 is in place and the stone D is positioned inside the central opening O of the saw S, the power supply connector 90 is connected to the apparatus and the on/off button 94*a* is switched to the on position to energize the apparatus. The operator then pushes the test button 94*b* to move the stone D to a position near the cutting surfaces of the saw S to visually check the position of the stone relative to the saw. If the position of the stone needs adjustment, the operator loosens the lever 38, moves the apparatus 10 as needed, and retightens the lever to clamp the apparatus in position on the post P.

After the set-up has been checked to ensure that the stone D is properly positioned, the operator pushes the dressing sequence button 94*c* to actuate the apparatus 10. In response, the motor 18 rotates the shaft 14 so the dressing stone D moves along the arc A from the position shown in FIG. 3 to the position shown in FIG. 4 and is progressively pushed against the cutting surfaces of the saw S to dress those surfaces. Although other speeds are envisioned as being within the scope of the present invention, the controller 20 of the preferred embodiment moves the stone D against the cutting surfaces of the saw S at a rate of about one inch per minute. The rotational movement of the shaft 14, and thus the stone D, is controlled by a program (e.g., a Compumotor program, XP9 XE1 XE3 LD3 XD1 LD3 MN A1 V.25 D6000 G T7 D-6000 G XT XE2 XD2 LD3 MN A1 V.25 D6000 G V.01 D14000 G V.1 D-20000 G XT Z) stored in the indexer/drive 88. If desired, the dressing operation may be repeated; however, the stone D must be repositioned before each dressing operation.

As will be apparent to those skilled in the art, the apparatus 10 described above has several advantages. Because the apparatus 10 is portable, it may be used on more than one saw assembly. Consequently, fewer such apparatus are required. Further, multiple apparatus may be used with a single power supply. Moreover, because the apparatus 10 is controlled by an indexer/driver 88 rather than being manually controlled, it produces highly repeatable and consistent results.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Portable apparatus for dressing the cutting surfaces around a central opening of an annular inside diameter saw, said apparatus comprising:

a base;

a shaft mounted on the base for rotation on a longitudinal axis of the shaft, said shaft being adapted to be positioned adjacent the central opening of the saw;

a fixture mounted on the shaft for holding a dressing stone in the central opening of the saw; and a motor operatively connected to the shaft for rotating the shaft about the longitudinal axis to move the dressing stone held by the fixture along an arc centered on the longitudinal axis of the shaft into engagement with the cutting surfaces of the saw when the saw is rotating thereby to remove deposits from the cutting surfaces of the saw.

2. Apparatus as set forth in claim 1 further comprising a controller for controlling the motor to rotate the shaft to cause a selected movement of the dressing stone.

3. Apparatus as set forth in claim 2 wherein the controller is programmable to control movement of the dressing stone with respect to the inward facing cutting surfaces of the saw.

4. Apparatus as set forth in claim 3 wherein the controller is programmable to control movement of the dressing stone as a function of time.

5. Apparatus as set forth in claim 1 wherein the motor is a stepper motor for incrementally rotating the shaft thereby to progressively push the dressing stone against the cutting surfaces of the saw.

6. Apparatus for dressing the cutting surfaces around a central opening of an annular inside diameter saw, said apparatus comprising:

a base;

a shaft mounted on the base for rotation on a longitudinal axis of the shaft, said shaft being adapted to be positioned adjacent the central opening of the saw;

a fixture mounted on the shaft for holding a dressing stone in the central opening of the saw;

a stepper motor for incrementally rotating the shaft to move the dressing stone held by the fixture along an arc centered on the longitudinal axis of the shaft into engagement with the cutting surfaces of the saw when the saw is rotating thereby to progressively push the dressing stone against the cutting surfaces of the saw and remove deposits from the cutting surfaces of the saw;

a first pulley connected to the shaft;

a second pulley connected to the motor; and a belt engaging said first and second pulleys to operatively connect the motor to the shaft.

7. Apparatus as set forth in claim 6 wherein each of said first and second pulleys has evenly spaced teeth, and the belt has evenly spaced teeth which mesh with the teeth on said first and second pulleys to transmit power from the motor to the shaft.

8. A method of dressing the cutting surfaces of an annular inside diameter saw comprising the steps of:

mounting a dressing stone in a fixture mounted on a shaft;

positioning the mounted dressing stone inside the central opening of the saw; and actuating a motor operatively connected to the shaft for rotating the shaft about a longitudinal axis extending through the central opening of the saw to move the dressing stone held by the fixture along an arc lying in a plane generally perpendicular to a central axis of the saw to bring the stone into engagement with the cutting surfaces of the saw thereby to remove deposits from the surfaces.

9. A method as set forth in claim 8 further comprising the step of programming a controller to operate the motor to vary a rate of rotation of the stone.

* * * * *